US007892072B2

(12) United States Patent
Lee et al.

(10) Patent No.: US 7,892,072 B2
(45) Date of Patent: Feb. 22, 2011

(54) METHOD FOR DIRECTIONAL GRINDING ON BACKSIDE OF A SEMICONDUCTOR WAFER

(75) Inventors: SungYoon Lee, Inchon-si (KR); JungHoon Shin, Choongbook (KR); BoHan Yoon, Pusan (KR)

(73) Assignee: STATS ChipPAC, Ltd., Singapore (SG)

( * ) Notice: Subject to any disclaimer, the term of this patent is extended or adjusted under 35 U.S.C. 154(b) by 672 days.

(21) Appl. No.: 11/852,771

(22) Filed: Sep. 10, 2007

(65) Prior Publication Data

US 2009/0068933 A1 Mar. 12, 2009

(51) Int. Cl.
*B24B 1/00* (2006.01)

(52) U.S. Cl. ..... 451/41; 451/58; 451/63

(58) Field of Classification Search ..... 451/41, 451/57, 58, 63; 438/690, 462, 459, 977; 257/797

See application file for complete search history.

(56) References Cited

U.S. PATENT DOCUMENTS 4,096,619 A * 6/1978 Cook, Jr. ..... 29/413
6,184,064 B1 2/2001 Jiang et al.
6,261,919 B1 * 7/2001 Omizo ..... 438/401
7,238,543 B2 * 7/2007 Tandy et al. ..... 438/26
2006/0079011 A1 * 4/2006 Tandy et al. ..... 438/14

* cited by examiner

*Primary Examiner*—Timothy V Eley
(74) *Attorney, Agent, or Firm*—Robert D. Atkins; Patent Law Group

(57) ABSTRACT

A backside grinding apparatus removes semiconductor material from a surface of a semiconductor wafer. The wafer is mounted to a backing plate. The backside surface undergoes a first grinding operation in a rotational motion to remove excess semiconductor material. The semiconductor wafer is then aligned such that edges of the die are oriented along a reference line. The backside surface undergoes a second grinding operation in a linear direction on a 45-diagonal with respect to the reference line to create linear grind marks which are diagonal to the edges of the die. The linear grind marks are formed by an abrasive surface having at least 4000 mesh count. The second grinding operation removes the radial grind marks produced by the first grinding operation. The linear grind marks oriented diagonal with respect to the reference line increases the strength of the die to resist cracking.

19 Claims, 3 Drawing Sheets

METHOD FOR DIRECTIONAL GRINDING ON BACKSIDE OF A SEMICONDUCTOR WAFER

FIELD OF THE INVENTION

The present invention relates in general to semiconductor wafer manufacturing and, more particularly, to a system and method of directional grinding on backside of a semiconductor wafer.

BACKGROUND OF THE INVENTION

Semiconductor devices are found in many products used in modern society. Semiconductors find applications in consumer items such as entertainment, communications, and household items markets. In the industrial or commercial market, semiconductors are found in military, aviation, automotive, industrial controllers, and office equipment.

The manufacture of semiconductor devices involves formation of a wafer having a plurality of die. Each die contains hundreds or thousands of transistors and other active and passive devices performing one or more electrical functions. For a given wafer, each die from the wafer performs the same electrical function. Front-end manufacturing generally refers to formation of the devices on the wafer. Back-end manufacturing refers to cutting or singulating the finished wafer into the individual die and then packaging the die for structural support and environmental isolation.

A semiconductor wafer generally includes an active front side surface having integrated circuits formed thereon, and a backside surface formed with bulk semiconductor material, e.g., silicon. During the front-end manufacturing, the wafer is typically subject to a grinding operation on the backside to remove excess bulk semiconductor material. The front side of the wafer is mounted to protective tape and placed front side down on a backing plate or chuck. A grinding wheel 12 is applied in a rotational motion to the backside surface of semiconductor wafer 14 to remove a portion of the bulk semiconductor material and create a substantially planar surface, as shown in FIG. 1. Grinding wheel 12 and wafer 14 each rotate in opposite directions. The backside grinding reduces the thickness of the integrated circuit chips, allows smaller packaging, and reduces stress in laminated packages.

Many manufacturers prefer to use rotational backside grinding on the wafer in lieu of chemical mechanical polishing (CMP) to remove excess semiconductor material and produce a planar surface. The ion contamination in slurry used in CMP can cause electrical malfunctions in the device. However, non-polished wafers still have many problems, including susceptibility of the die to cracking around the edges. The backside grinding may involve coarse grinding followed by fine grinding to remove excess semiconductor material and other irregularities from the backside surface. The grinding process leaves arc-shaped curves or marks in the wafer surface. The grinding marks extend radially outward from the wafer center.

In analyzing semiconductor die failures, the individual die are known to have problems with cracking along lines parallel or normal to the edges of the die. The die failure is attributed to the radial grind marks creating a weak plane in the crystal lattice structure (100) of the silicon wafer. The strength of the die depends upon the angle of the grind marks, ranging from a maximum value at zero degrees to a minimal value at 90 degrees. The highest risk of die cracking occurs when the grind marks run along the same line as the die edge. Intermediate die strength areas occur between about 40-70 degrees.

In any case, the angle of the grind marks influences the strength of the wafer and accordingly the rate of die failures due to cracking.

A need exists to reduce die cracking arising from backside wafer grinding.

SUMMARY OF THE INVENTION

In one embodiment, the present invention is a method of removing semiconductor material from a surface of a semiconductor wafer comprising the steps of mounting the semiconductor wafer to a backing plate, the semiconductor wafer having a plurality of die and a front surface with active devices formed thereon facing the backing plate and a backside surface facing opposite to the backing plate, grinding the backside surface of the semiconductor wafer in a rotational motion grinding the backside surface of the semiconductor wafer in a rotational motion to remove excess semiconductor material, aligning the semiconductor wafer such that edges of the die are oriented along a reference line, and grinding the backside surface of the semiconductor wafer in a linear direction diagonal to the reference line to create linear grind marks which are oriented diagonal to the edges of the die.

In another embodiment, the present invention is a method of removing semiconductor material from a backside surface of a semiconductor wafer comprising the steps of mounting the semiconductor wafer to a backing plate, the semiconductor wafer having a plurality of die, aligning the semiconductor wafer such that edges of the die are oriented along a reference line, and grinding the backside surface of the semiconductor wafer in a linear direction diagonal to the reference line to create linear grind marks which are diagonal to the edges of the die.

In another embodiment, the present invention is a semiconductor grinding apparatus for removing material from a backside surface of a semiconductor wafer comprising a backing plate and a semiconductor wafer mounted to the backing plate. The semiconductor wafer has a plurality of die and a front surface with active devices formed thereon facing the backing plate and a backside surface facing opposite to the backing plate. The semiconductor wafer is aligned such that edges of the die are oriented along a reference line. A first grinding platform has an abrasive surface which is applied to the backside surface of the semiconductor wafer in a linear direction diagonal to the reference line to create linear grind marks which are diagonal to the edges of the die.

In another embodiment, the present invention is a semiconductor wafer having a plurality of die comprising a front surface with active devices formed thereon and a backside surface having linear grind marks oriented diagonal with respect to edges of the die. The grind marks are formed by a linear motion of an abrasive surface.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

The manufacture of semiconductor devices involves formation of a wafer having a plurality of die. Each die contains hundreds or thousands of transistors and other active and passive devices performing one or more electrical functions. For a given wafer, each die from the wafer performs the same electrical function. Front-end manufacturing generally refers to formation of the transistors on the wafer. Back-end manufacturing refers to cutting or singulating the finished wafer into the individual die and then packaging the die for structural support and environmental isolation.

A semiconductor wafer generally includes an active front side surface having integrated circuits disposed thereon, and a backside surface formed with bulk semiconductor material, e.g., silicon. The active front side surface contains a plurality of semiconductor die having edges defining a rectangular form factor. The active surface is formed by a variety of semiconductor processes, including layering, patterning, doping, and heat treatment. In the layering process, semiconductor materials are grown or deposited on the substrate by techniques involving thermal oxidation, nitridation, chemical vapor deposition, evaporation, and sputtering. Patterning involves use of photolithography to mask areas of the surface and etch away undesired material to form specific structures. The doping process injects concentrations of dopant material by thermal diffusion or ion implantation. The active surface is substantially planar and uniform with electrical interconnects, such as bond wires.

During the manufacturing process, the semiconductor wafer is typically subject to a grinding operation on the backside to remove excess bulk semiconductor material. Many manufacturers prefer to use backside grinding on the wafer in lieu of chemical mechanical polishing (CMP) because the ion contamination in slurry used in CMP can cause electrical malfunction in the device.

Figure 1:
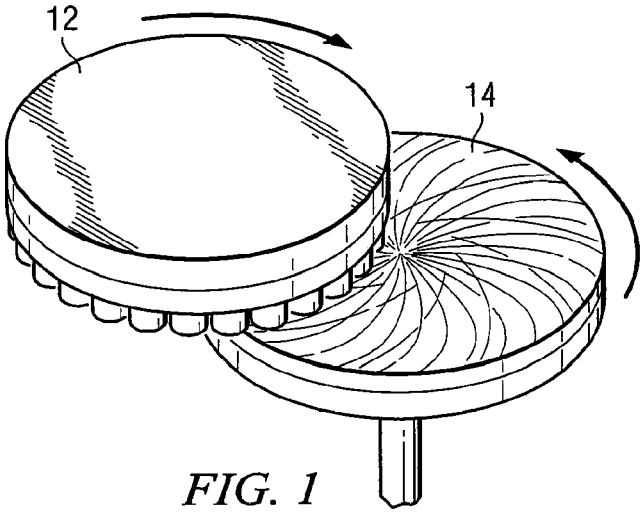
FIG. 1 (PRIOR ART)
FIG. 1 illustrates a conventional rotational backside grinding process on a semiconductor wafer.
Figure 2:
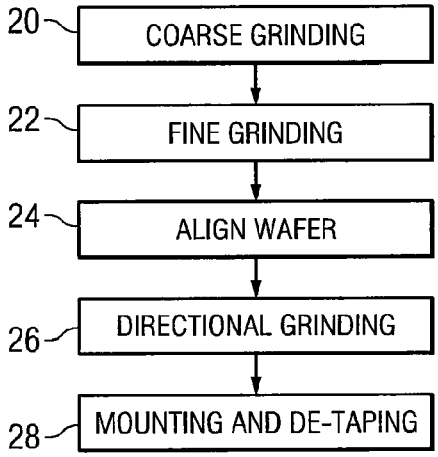
FIG. 2 illustrates a backside grinding process for removing semiconductor material.

In FIG. 2, the backside grinding involves coarse grinding in block 20 followed by fine grinding in block 22. Prior to back grinding, the backside surface of the semiconductor wafer exhibits a substantially non-planar contour in various different shapes, including sinuate, square, triangular, saw tooth, and the like, at a variety of different depths as measured from peak-to-valley of each contour. The coarse grinding is performed with a 300-600 mesh count wheel. The fine grinding is performed with a 2000 mesh count wheel. The backgrinding removes excess bulk semiconductor material and other backside surface irregularities and create a substantially planar surface.

Figure 3:
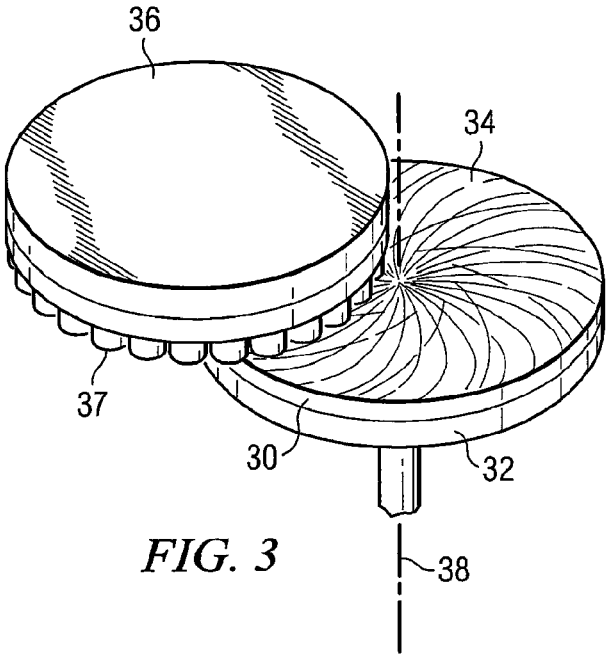
FIG. 3 illustrates a first rotational grinding operation producing arc-shaped grind marks.

In FIG. 3, semiconductor wafer 30 is shown with a front surface having active devices and a back surface 34. In one embodiment, semiconductor wafer 30 is attached to a backing plate or chuck 32 with the front side of the wafer facing down. The backing plate holds semiconductor wafer 30 fixed in vertical and horizontal planes. Grinding wheel 36 with abrasive surface 37 is applied to the backside surface of semiconductor wafer 30. In one embodiment, the grinding wheel remains stationary while semiconductor wafer 30 rotates with the backing plate about axis of rotation 38. Alternately, grinding wheel 36 and wafer 30 each rotate in opposite directions to remove excess bulk semiconductor material.

In the process of removing the excess bulk semiconductor material, the coarse and fine grinding steps leave wheel arc-shaped curves or radial marks in the wafer surface. The grinding marks extend radially outward from the wafer center, as shown in FIG. 3. However, the radial grind marks are known to weaken the crystal lattice structure of the silicon wafer and subject the die to cracking around the edges. It is desirable to remove the radial grind marks to reduce die failures due to cracking.

In block 24 of FIG. 2, the semiconductor wafer is aligned in preparation for the direction grinding in block 26. As described below, the directional grinding removes the radial grind marks formed by the coarse and fine grinding and creates linear grind marks or lines in the backside surface of the wafer. The wafer is aligned to control the orientation of the linear grind marks relative to the edges of the rectangular die.

Figure 4:
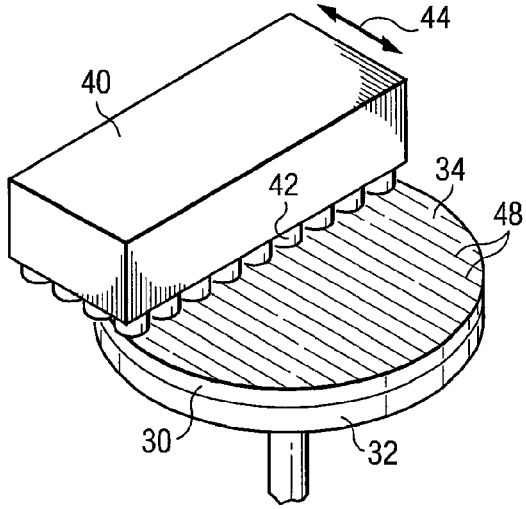
FIG. 4 illustrates a second directional grinding operation producing linear grind marks formed diagonal to edges of the die.

A directional grinding is performed to the backside surface of the semiconductor wafer in block 26. The directional grinding involves fixing semiconductor wafer 30 to a backing plate or chuck 32 with the front side of the wafer facing down. A grinding platform 40 having abrasive surface 42 is applied to the backside surface 34, as shown in FIG. 4. In one embodiment, wafer 30 remains stationary while grinding platform 40 moves back and forth as shown by directional arrows 44. Alternatively, grinding platform 40 remains stationary while wafer 30 moves back and forth according to directional arrows 44. In either case, the abrasive surface 42 of grinding platform 40 grinds semiconductor wafer 30 to remove the radial grind marks from the coarse and fine grinding steps and creates linear grind marks or lines 48 in backside surface 34. The abrasive surface used in the directional grinding process is ultra fine in comparison to the coarse grinding or fine grinding, e.g., having at least 4000 mesh count. Thus, the purpose of the coarse and fine grinding in steps 20 and 22 is to remove excess bulk semiconductor material from the backside of the wafer. The purpose of directional grinding in step 26 is to remove the radial grind marks produced by the coarse and fine grinding steps and leave only linear grind marks on the backside surface of the wafer.

Figure 5:
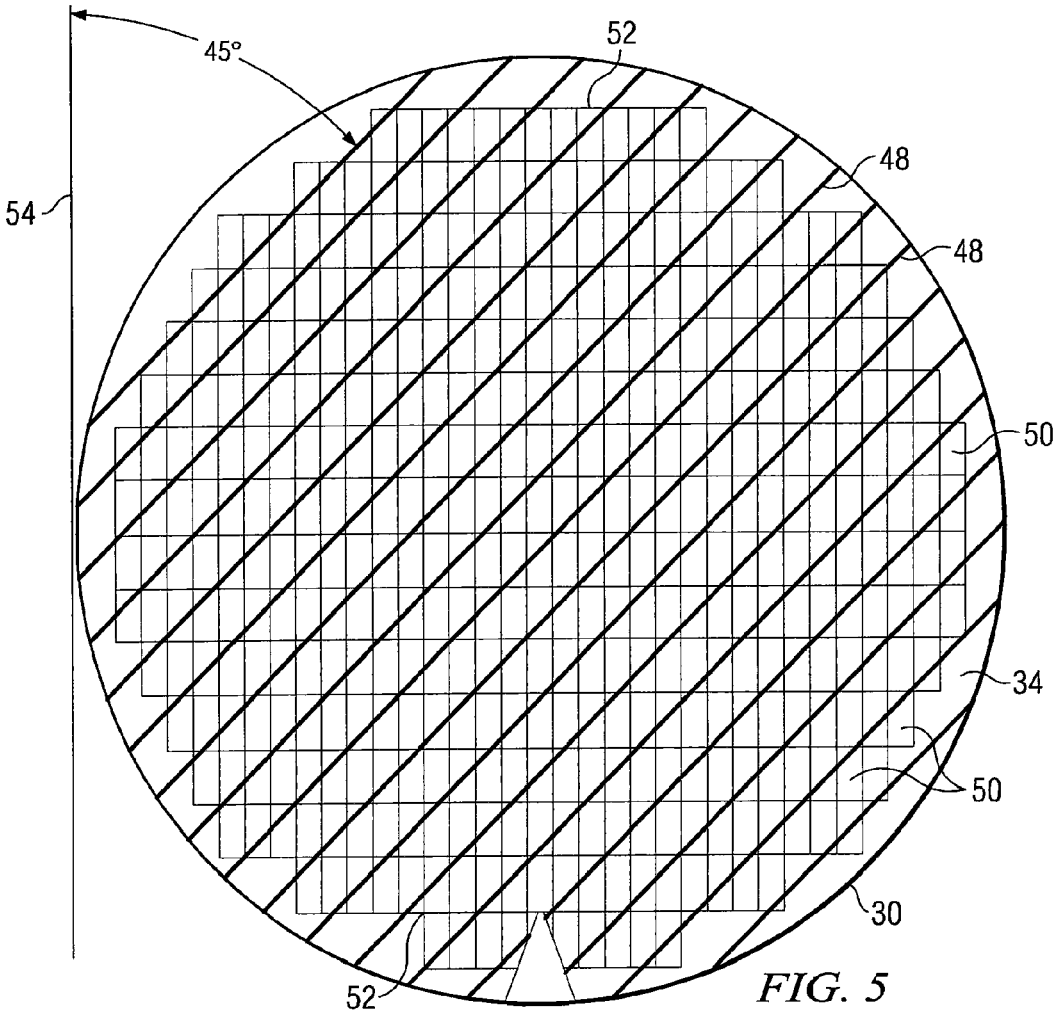
FIG. 5 illustrates grind marks oriented on a diagonal with respect to edges of the die.

In the alignment process 24, the semiconductor wafer is positioned so that the directional grinding creates linear grind marks which are uniformly diagonal with respect to reference line 54 oriented along the edges of die 50 as shown in FIG. 5. In one embodiment, the wafer is oriented so that the grind marks are aligned about 45 degrees with respect to reference line 54 which are parallel or normal to the v-notch or flat 52 of the wafer. The outline of die 50 are shown for illustration purposes of the diagonal alignment of grinding marks 48 with respect to the edges of the die.

Figure 6:
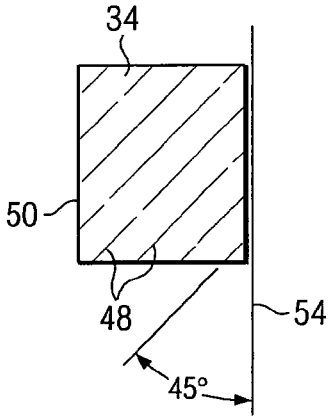
FIG. 6 illustrates grind marks oriented on a 45-degree diagonal to edges of the die.

FIG. 6 shows further detail of grind marks 48 running diagonally across the backside surface relative to reference line 54 oriented along the edges of the rectangular die 50. The linear grind marks 48 are created by the directional motion of grinding platform 40, which is aligned to the diagonal of reference line 54 of wafer 30.

Figure 7:
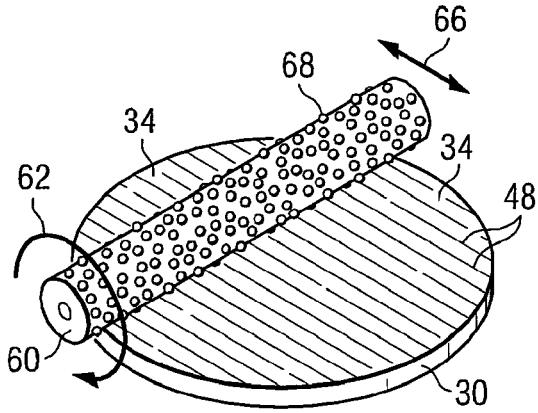
FIG. 7 illustrates a cylinder having an abrasive surface to form linear grind marks oriented on a diagonal to edges of the die.

FIG. 7 illustrates a cylindrical embodiment of grinding platform 40. Grinding cylinder 60 rolls across the backside surface of wafer 30 according to arrow 62 in a back and forth motion by directional arrow 66. Grinding cylinder 60 contains abrasive surface 68, which creates grind marks 48 on backside surface 34.

Figure 8:
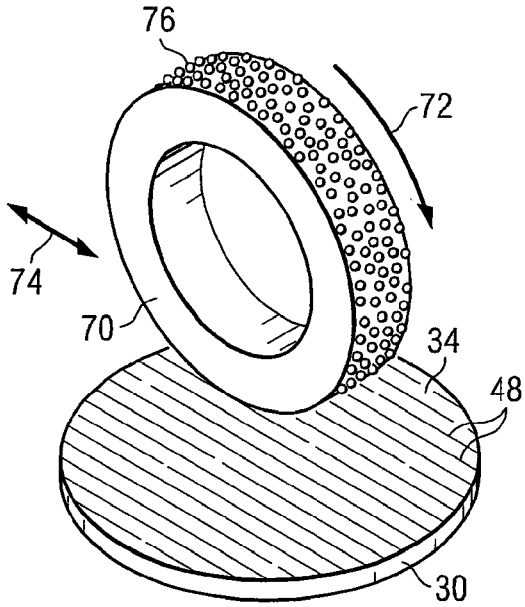
FIG. 8 illustrates a wheel having an abrasive surface to form linear grind marks oriented on a diagonal to edges of the die.

FIG. 8 illustrates a wheel embodiment of grinding platform 40. Grinding cylinder 70 rolls across the backside surface of wafer 30 according to arrow 72 in a back and forth motion by directional arrow 74. Grinding wheel 70 contains abrasive surface 76, which creates grind marks 48 on backside surface 34.

Block 28 of FIG. 2 shows the mounting and de-taping step to complete the backside grinding process.

The diagonal grind marks reduces die cracking for applications relying solely on backside grinding to planarize the back surface of the wafer. The diagonal grinding process described herein increases the strength of the die, particularly around the edges. The directional backside grinding also eliminates the need for CMP, which can cause ion contamination from the slurry resulting in wafer breakage or damage during the polishing process. Accordingly, directional backside grinding reduces wafer fabrication costs.

While one or more embodiments of the present invention have been illustrated in detail, the skilled artisan will appreciate that modifications and adaptations to those embodiments may be made without departing from the scope of the present invention as set forth in the following claims.

What is claimed is:

1. A method of removing semiconductor material from a surface of a semiconductor wafer, comprising:

mounting the semiconductor wafer to a backing plate, the semiconductor wafer having a plurality of die and a front surface with active devices formed thereon facing the backing plate and a backside surface facing opposite to the backing plate;

grinding the backside surface of the semiconductor wafer in a rotational motion to remove excess semiconductor material;

aligning the semiconductor wafer such that edges of the die are oriented along a reference line; and grinding the backside surface of the semiconductor wafer in a linear direction diagonal to the reference line to create linear grind marks which are oriented diagonal to the edges of the die.

2. The method of claim 1, further including forming the linear grind marks on a 45-degree diagonal with respect to the reference line.

3. The method of claim 1, further including forming the linear grind marks with a cylinder having an abrasive surface.

4. The method of claim 1, further including forming the linear grind marks with a wheel having an abrasive surface.

5. The method of claim 1, further including forming the linear grind marks with an abrasive surface having at least 4000 mesh count.

6. The method of claim 1, wherein the linear grind marks oriented on a diagonal with respect to the reference line increase the strength of the die to resist cracking.

7. The method of claim 1, wherein the grinding removes semiconductor material to create a planar backside surface without polishing.

8. A method of removing semiconductor material from a backside surface of a semiconductor wafer, comprising:

mounting the semiconductor wafer to a backing plate, the semiconductor wafer having a plurality of die;

aligning the semiconductor wafer such that edges of the die are oriented along a reference line; and grinding the backside surface of the semiconductor wafer in a linear direction diagonal to the reference line to create linear grind marks which are oriented diagonal to the edges of the die.

9. The method of claim 8, further including grinding the backside surface of the semiconductor wafer in a rotational motion prior to grinding the backside surface in a linear direction diagonal to the reference line.

10. The method of claim 8, further including forming the linear grind marks on a 45-degree diagonal with respect to the reference line.

11. The method of claim 8, further including forming the linear grind marks with a cylinder having an abrasive surface.

12. The method of claim 8, further including forming the linear grind marks with a wheel having an abrasive surface.

13. The method of claim 8, further including forming the linear grind marks with an abrasive surface having at least 4000 mesh count.

14. A method of removing semiconductor material from a semiconductor wafer having a plurality of die, a front surface with active devices formed thereon, and a backside surface opposite the front surface, the method comprising:

grinding the backside surface using a rotational motion to remove excess semiconductor material;

after grinding the backside surface using the rotational motion, aligning the semiconductor wafer such that two edges of each die are oriented substantially parallel to a reference line; and after aligning the semiconductor wafer, grinding the backside surface in a linear direction to form linear grind marks in the semiconductor wafer, the linear direction intersecting the reference line at an angle.

15. The method of claim 14, wherein the angle is substantially 45 degrees.

16. The method of claim 14, wherein grinding the backside surface comprises grinding such that all the linear grind marks on the wafer are substantially parallel.

17. A method of removing semiconductor material from a backside surface of a semiconductor wafer having a plurality of die, the method comprising:

aligning the semiconductor wafer such that two edges of each die are oriented along a reference line; and grinding the backside surface of the semiconductor wafer in a linear direction that is at an angle relative to the reference line to create linear grind marks in the wafer, the linear grind marks oriented to the two edges of each die at the angle.

18. The method of claim 17, wherein the angle is substantially 45 degrees.

19. The method of claim 17, wherein grinding the backside surface comprises grinding such that all the linear grind marks on the wafer are substantially parallel.

* * * * *